US006012520A

United States Patent [19]

Yu et al.

[11] Patent Number: 6,012,520

[45] Date of Patent: Jan. 11, 2000

[54] HYDROCARBON RECOVERY METHODS BY CREATING HIGH-PERMEABILITY WEBS

[76] Inventors: Andrew Yu, 3528 W. Lake Dr., Martinez, Ga. 30907; Peter Tsou, 5700 Braxton, Suite 190, Houston, Tex. 77036

[21] Appl. No.: 09/225,527

[22] Filed: Jan. 4, 1999

Related U.S. Application Data

[63] Continuation of application No. 08/731,334, Oct. 11, 1996, abandoned.

[51] Int. Cl.[7] ..... E21B 43/24; E21B 43/26; E21B 43/30

[52] U.S. Cl. ..... 166/245; 166/50; 166/248; 166/268; 166/272.7; 166/308

[58] Field of Search ..... 166/50, 245, 248, 166/268, 272.7, 271, 306, 308; 299/17; 175/67

[56] References Cited

U.S. PATENT DOCUMENTS

| | | | |
|---|---|---|---|
| 4,022,279 | 5/1977 | Driver | 166/271 |
| 4,754,808 | 7/1988 | Harmon et al. | 166/245 |
| 4,889,186 | 12/1989 | Hanson et al. | 166/245 X |
| 5,082,054 | 1/1992 | Kiamanesh | 166/248 |
| 5,273,111 | 12/1993 | Brannan et al. | 166/245 |
| 5,299,887 | 4/1994 | Ensley | 405/128 |
| 5,320,170 | 6/1994 | Huang et al. | 166/245 |
| 5,363,927 | 11/1994 | Frank | 299/17 X |
| 5,413,184 | 5/1995 | Landers | 175/62 |
| 5,875,843 | 3/1999 | Hill | 166/308 X |

*Primary Examiner*—George Suchfield
*Attorney, Agent, or Firm*—Fulbright & Jaworski L.L.P.

[57] ABSTRACT

A gravity-drainage hydrocarbon recovery method is provided to produce oil and gas from subterranean formations. A substantially horizontal high-permeability web is created at the bottom portion of an oil reservoir. The web is connected to a production well. The high-permeability web is fabricated by conventional drilling, high-pressure water jet drilling, and high-power microwave fracturing. Primary oil recovery will benefit from this configuration in terms of improved volumetric sweep efficiency, delayed gas break through, increased oil production rate and overall oil recovery. This method is also used with secondary oil recovery for which a gas is injected into the upper portion of a reservoir. Oil is produced from the bottom portion of the reservoir. If economically warranted, high-permeability web is also implemented to the injection well. The method for this invention is also used in conjunction with any horizontal and vertical well arrangement methods, enhanced oil recovery methods, and methods used for oil field conformance improvement.

21 Claims, 6 Drawing Sheets

HYDROCARBON RECOVERY METHODS BY CREATING HIGH-PERMEABILITY WEBS

This is a continuation, of application Ser. No. 08/731,334 filed Oct. 11, 1996, now abandoned. This application claims the benefits of application Ser. No. 08/731,334 filed Oct. 11, 1996. This application incorporates by reference the entire text of the 08/731,334 application.

BACKGROUND OF THE INVENTION

The present invention relates to methods for recovering hydrocarbons from a subterranean formation. The emphasis is on oil reservoirs. However, the methods are also applicable to gas, gas condensate, shale oil and tar sand formations. The fundamental technique used by the invention is to create a horizontal, high-permeability web at the bottom portion of a reservoir. This technique is made possible by recent developments in drilling and microwave technologies.

One of the simple ways to produce oil is to drill a single vertical well into an oil-bearing formation. Oil will be produced by the natural energy within the reservoir, such as expansion of gas cap or solution gas drive. After producing a fraction of the original oil in place (OOIP), it is becoming less economically attractive to deplete the reservoir by this primary recovery mechanism. A secondary production method is needed to push the oil through the formation. The basic scheme for secondary recovery is to drill a vertical well at certain distance away from the original well. Fluids such as gases or water are injected into one of the wells under relatively high pressure. Oil and other fluids are produced from the other well under relatively low pressure.

A drawback of using two vertical wells is poor volumetric sweep efficiency. Injected fluids tend to take a short path between adjacent injection and production wells that causes poor horizontal sweep. Gases tend to migrate through the upper portion of the reservoir. Water tends to migrate through the lower portion of the reservoir. These result in poor vertical sweep. Poor horizontal sweep results from well configuration. Gas gravity override and water gravity underride result from density differences between injected and reservoir fluids. Another phenomenon leading to poor volumetric sweep efficiency results from unfavorable mobility ratio. Viscosity of injected fluids is lower than that of the reservoir oil, which causes uneven frontal development known as viscous fingering. Even if there were no density and viscosity differences, injected fluids could still channel through more permeable strata, leaving a significant portion of the formation volume upswept. An oil recovery method mitigating these undesirable effects will enjoy increased oil recovery due to improved volumetric sweep efficiency.

Two of the methods used to improve volumetric sweep efficiency pertinent to this invention are gravity drainage and the use of horizontal wells. The following reference to prior arts will be focused on gas injection because gas injection is the preferred embodiment of this invention. After injected gas breaks through a production well, oil production rate falls off. Gas production rate increases. Excessive and early production of the injected gases is undesirable. It reduces the overall recovery, prolongs the operation, and imposes additional costs of processing and reinjecting produced gases, as disclosed in U.S. Pat. No. 4,368,781, to Anderson.

The most effective method to minimize gas production is gravity drainage. One of the earliest and probably the most widely used methods for gravity drainage is to perforate a production well at the bottom portion of a reservoir. Taking a horizontal cross section of the perforated zone, the wellbore acts as a single point pressure sink. There is a large pressure drop around the wellbore due to radial flow. The pressure drop is proportional to production rate. For a low-permeability reservoir, oil production rate is often limited by the parting pressure of the formation.

Numerous patent disclosures are related to horizontal wells. See Allen U.S. Pat. No. 4,410,215, Brannan et. al. U.S. Pat. No. 5,273,111, Brown et. al. U.S. Pat. No. 4,718,485, Huang et. al. U.S. Pat. Nos. 4,702,314, 5,065,821 and 5,320,170, Mullins et. al. U.S. Pat. No. 4,385,662, and Shu et. al. U.S. Pat. No. 4,598,770. A horizontal production well acts as a linear pressure sink. It provides a relatively large area for flow that results in smaller pressure drop and improved volumetric sweep efficiency.

The above patents include methods of spatial arrangements of horizontal and vertical wells. The purpose of this invention is not to disclose new well arrangement patterns. Instead, it is to adapt high-permeability web to any well arrangement configuration as known in the art. Therefore, only an inverted 5-spot pattern and a pattern of parallel horizontal wells are used as preferred embodiments. Inverted 5-spot patterns are found in many oil fields. Such a pattern consists of one vertical injection well and four vertical production wells. A modified inverted 5-spot pattern is disclosed in U.S. Pat. No. 5,320,170 to Huang et. al., adding four horizontal wells along the sides. The other preferred embodiment teaches drilling laterally and vertically staggered horizontal wells as disclosed in U.S. Pat. No. 5,237,111 to Brannan et. al.

Two of the technologies are modified and used to create a high-permeability web around a vertical or horizontal well. One is high-pressure water jet as disclosed in U.S. Pat. No. 5,413,184 to Landers. The other is high-power microwave energy as disclosed in U.S. Pat. No. 5,299,887 to Ensley. The high-pressure water jet cuts a channel into a formation at a distance of 200 feet and beyond. The contemplated application of the technique is to cut additional branches of channels at different locations and directions. For the microwave technology, an antenna is lowered into a production well to the bottom portion of an oil-bearing formation. The antenna generates electromagnetic waves at selected frequencies. The frequencies used for this application are in the Ghz range, or microwaves. High-power microwave beams aimed horizontally will penetrate the formation up to 100 feet. The microwave frequencies are selected to maximize vaporization of hydrocarbons and water in the porous media. Because the high-power microwave energy is delivered rapidly, vaporization is completed in seconds or minutes. The sudden generation of large amounts of gases will fracture the formation, resulting in a permeability increase of several orders of magnitude, along the path of microwave penetration. Produced gases return to the production well through the high-permeability channel. The direction of microwave penetration is rotated until a desired fracture pattern has been developed. The above technologies produce a horizontal, high-permeability web around the wellbore. Because the entire high-permeability web acts as the pressure sink, the pressure drop is small.

Gravity drainage is also used in conjunction with any enhanced oil recovery (EOR) method. The purpose of EOR is to improve mobility control and displacement efficiency. Mobility control mitigates viscous fingering. Improved displacement efficiency reduces residual oil saturation in the pores that have been swept by the injected fluid. Common EOR methods include thermal (e.g., steam and combustion), miscible (e.g., $CO_2$), and chemical (e.g. surfactant and polymer). Examples of recent disclosures of EOR methods used with gravity drainage are thermally assisted gravity segregation disclosed in U.S. Pat. No. 5,503,226 to Wadleigh; and horizontal well gravity drainage combustion process disclosed in U.S. Pat. No. 5,456,315 to Kisman, et. al.

Additional factors affecting gravity drainage are properties of the reservoir and injected fluids, stratification and flow characteristics of the porous media, oil field facilities, operation strategies, and process economics. These factors will also affect the implementation of high-permeability webs.

SUMMARY OF THE INVENTION

The present invention provides a novel and improved method for recovering hydrocarbons from a subterranean formation. The method is applied to primary and secondary recovery processes. It is also compatible with horizontal and vertical well arrangement methods, enhanced oil recovery methods, and methods used to improve the oil field conformance.

In a simple embodiment, the method is used to produce oil from primary recovery mechanism, e.g., reservoir under strong gas cap or solution gas drive. A vertical well is drilled into the oil-bearing formation. A special horizontal well drilling tool then may be lowered into the well. The tool generates one or more high-pressure water jet aimed at a horizontal direction that cuts one or more horizontal channel through the formation. At least four of these channels are drilled. Secondary channels are also created by high-pressure water jet. The secondary channels branch from the horizontal wells. A horizontal, high-permeability web has been constructed at the bottom portion of the reservoir.

Another method of creating a high-permeability web is by high-power microwave fracturing. In this method, an antenna is lowered from a mobile microwave generation unit into the production well. One or more microwave beams of controlled frequencies, direction, intensity, and duration are applied to the adjacent formation. The microwave frequencies are chosen to maximize vaporization of the reservoir fluids. The power used for this application is in the megawatt range. The power intensity is maximized to provide maximum penetration. Hydrocarbons and water in the porous media are selectively vaporized by the microwave energy in seconds or minutes. The sudden generation of large amounts of vapors induces fractures in the path swept by the microwave, causing a permeability increase of many orders of magnitude. Permeability of the fractured formation is typically more than one Darcy. Generated vapors migrate toward the production well. The location for microwave release can be placed within a channel created by conventional or high-pressure water jet drilling.

The pressure in a high-permeability web is approximately equal to the bottomhole pressure. This configuration facilitates gravity drainage. In the oil-bearing zone, oil migrates downward. Gas migrates upward. The gas breakthrough is delayed. The volumetric sweep is improved. The rate of oil production is increased. The method also improves overall oil recovery.

In a further embodiment, the method of producing oil requires at least one additional injection well. Fluids are injected into the upper portion of the reservoir. The fluids include, but are not limited to, hydrocarbons, $CO_2$, steam, air, and flue gas. If there is a gas cap or a high-permeability layer at the upper portion of the reservoir, gases are injected into one of these structures. Otherwise, and if economically warranted, a high-permeability web is created to facilitate injection profile and injection rate. In this embodiment, injected fluids push oil from the upper to the lower portion of the formation. Injected fluids are also used to improve sweep and displacement efficiencies. Horizontal, high-permeability webs are compatible with any enhanced oil recovery method, as known in the art. In case of injecting a water based agent, such as surfactant and polymer solution, the injection and production configuration needs to be inverted. Water is injected into the bottom of the reservoir. Oil is produced from the top of the reservoir.

For most of the oil field operations, it is necessary to implement more than one injection well and one production well. The spatial arrangement of wells requires technical and management decision. High-permeability webs can be adapted to any well configurations as known in the art. Examples are given to two preferred embodiments. One is an inverted 5-spot pattern to take advantage of existing wells in a field. The other is laterally and vertically staggered horizontal wells as disclosed in U.S. Pat. No. 5,273,111 to Brannan et. al. An inverted 5-spot pattern has a center injector and four corner producers. These wells are drilled vertically. In a particular embodiment, four additional horizontal wells are completed. The horizontal wells are connected to a corner producer. Additional high-permeability branches are created to form a web. These branches are connected to the horizontal well. If economically warranted, a high-permeability web is also implemented to the center injector at the upper portion of the reservoir. This configuration uses all of the existing vertical wells in a 5-spot pattern. In the laterally and vertically staggered horizontal wells, high-permeability webs are created in the plane comprising the bottom horizontal production wells. High-permeability webs are also created in the top horizontal injection wells. Oil production schemes are the same as those described for one injection well and one production well.

The method used for hydrocarbon recovery from subterranean formation also depends on the properties of the formation and the reservoir fluids. Two of the problems affecting a gravity drainage process are low-permeability strata and bottom water coning. A low-permeability layer often acts as the bottleneck for vertical flow. Sometimes, it is more economical to produce from this formation as if there are two separate reservoirs. Sometimes, it is necessary to heat or fracture the low-permeability layer. Some of the heating and fracturing methods are disclosed in U.S. Pat. No. 5,449,889 to Samardzija and U.S. Pat. No. 5,299,887 to Ensley. High-power microwave technology is also used for the vitrification of rocks beneath the water-oil contact to mitigate bottom water coning.

The methods disclosed in this invention are also applicable to gas and gas condensate reservoirs and are modified for applications to heavy oil, shale oil and tar sands.

DETAILED DESCRIPTION OF PREFERRED EMBODIMENTS

The methods of the present invention provide improved means for recovering hydrocarbons from a subterranean formation. The methods of creating high-permeability webs are applied to primary and secondary oil recovery processes. They are also used in conjunction with horizontal and vertical well arrangement methods, enhanced oil recovery methods, and methods used for conformance enhancement.

Figure 1:
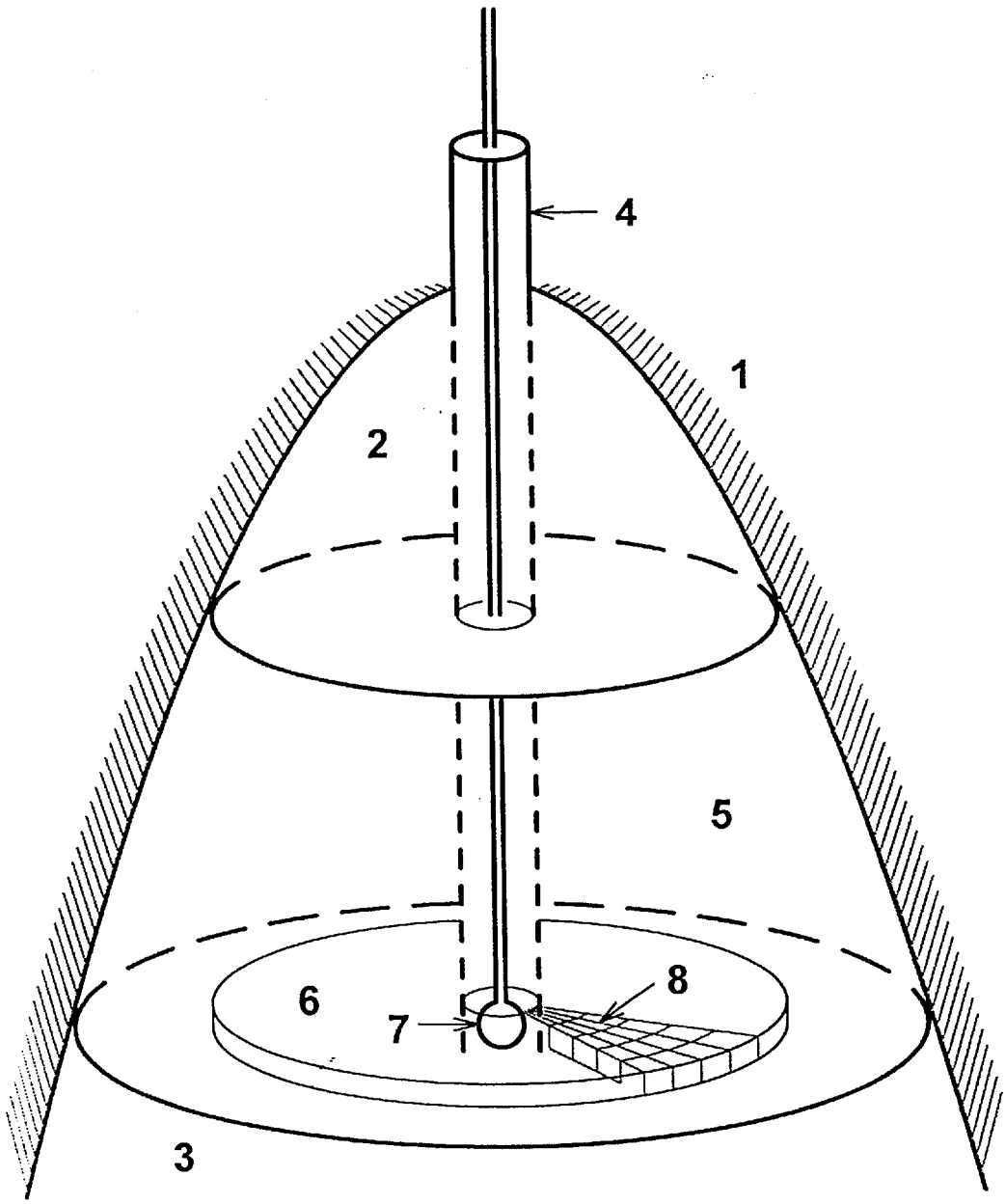
FIG. 1 is a diagrammatic illustration of a hydrocarbon reservoir in a subterranean formation in the process of being modified for enhanced production according to an embodiment of the present invention.
Figure 2:
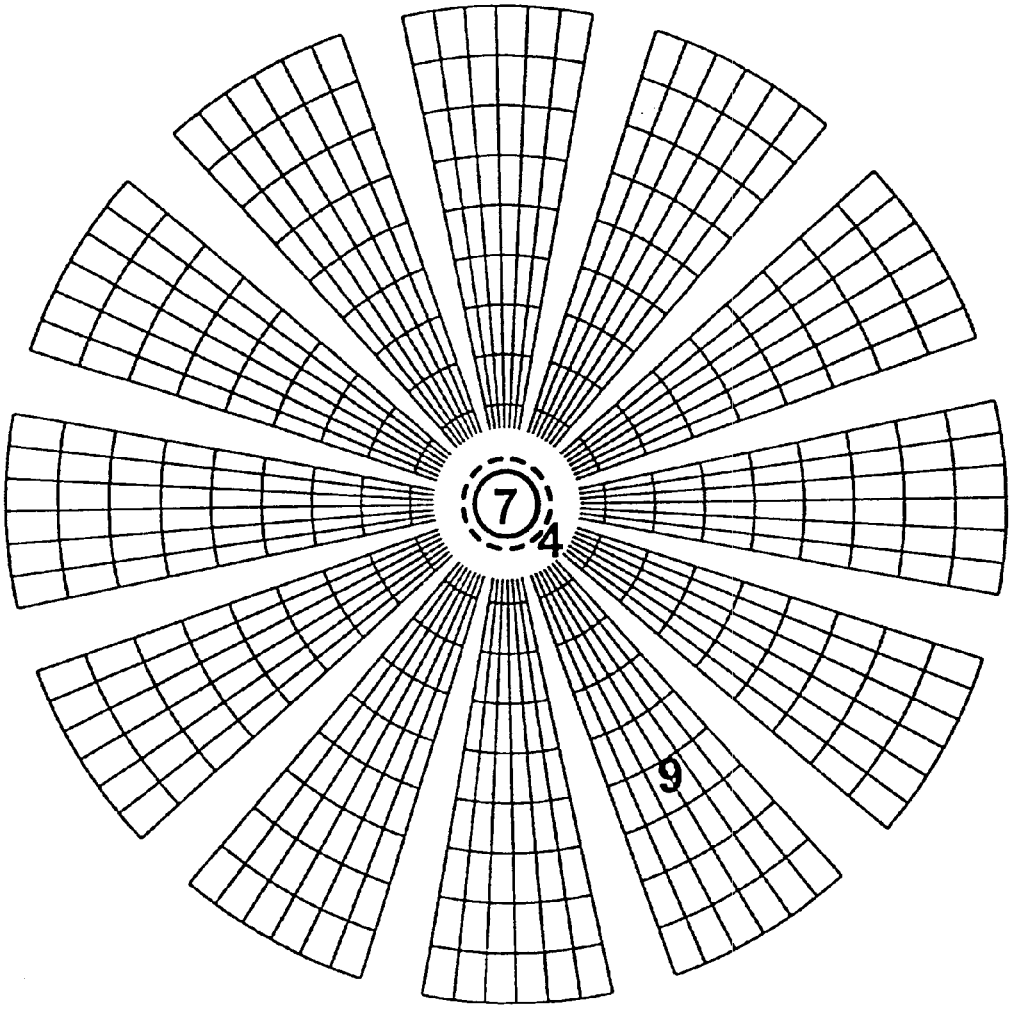
FIG. 2 is a top cross-sectional view of the high-permeability web formed according to the method of FIG. 1.

In a simple embodiment, the method is used to produce oil from primary recovery mechanism, e.g., a reservoir under strong gas cap or solution gas drive, as shown in FIG. 1. The reservoir is confined at the top and the sides in a dome formation 1. It contains a gas cap 2 and is bounded by an aquifer 3 at the bottom. A vertical well 4 is drilled into the oil-bearing formation 5. A method is used to create a high-permeability web 6 at the bottom portion of the reservoir. In this embodiment, a high-power microwave antenna 7 such as disclosed in U.S. Pat. No. 5,299,887 to Ensley is lowered into the well. The antenna generates a microwave beam 8, of controlled frequencies, direction, intensity, and duration. The frequencies are selected to maximize vaporization and pyrolysis of hydrocarbons and water in the reservoir. For this application, it is desirable to keep the microwave intensity high in order to achieve maximum penetration. High intensity results from high power and low area of exposure. Exposed hydrocarbons and water in the porous media are selectively vaporized, usually in seconds or minutes. The sudden generation of large amounts of vapors induces fractures in the path swept by microwave, causing a permeability increase of many orders of magnitude. Permeability of the fractured formation is typically more than one Darcy. Generated vapors migrate toward the production well. The direction of the microwave beam is substantially horizontal. A single beam or an array of beams aimed at different directions are generated simultaneously. Multiple applications are made to create a horizontal radial high-permeability web 6 shown in FIG. 2. This figure is a horizontal plane containing the web. The center of the web is the vertical production well 4 containing microwave antennae. The fractured zones 9 are the high-permeability webs created by microwave. The well is then put on production. Pressure in the high-permeability web is approximately equal to the bottomhole pressure. This pressure profile facilitates gravity drainage. In the oil-bearing zone, oil migrates downward. Gas migrates upward. The gas breakthrough is delayed. The volumetric sweep is improved. The rate of oil production is increased. It is contemplated that the overall oil recovery will also increase.

Figure 3:
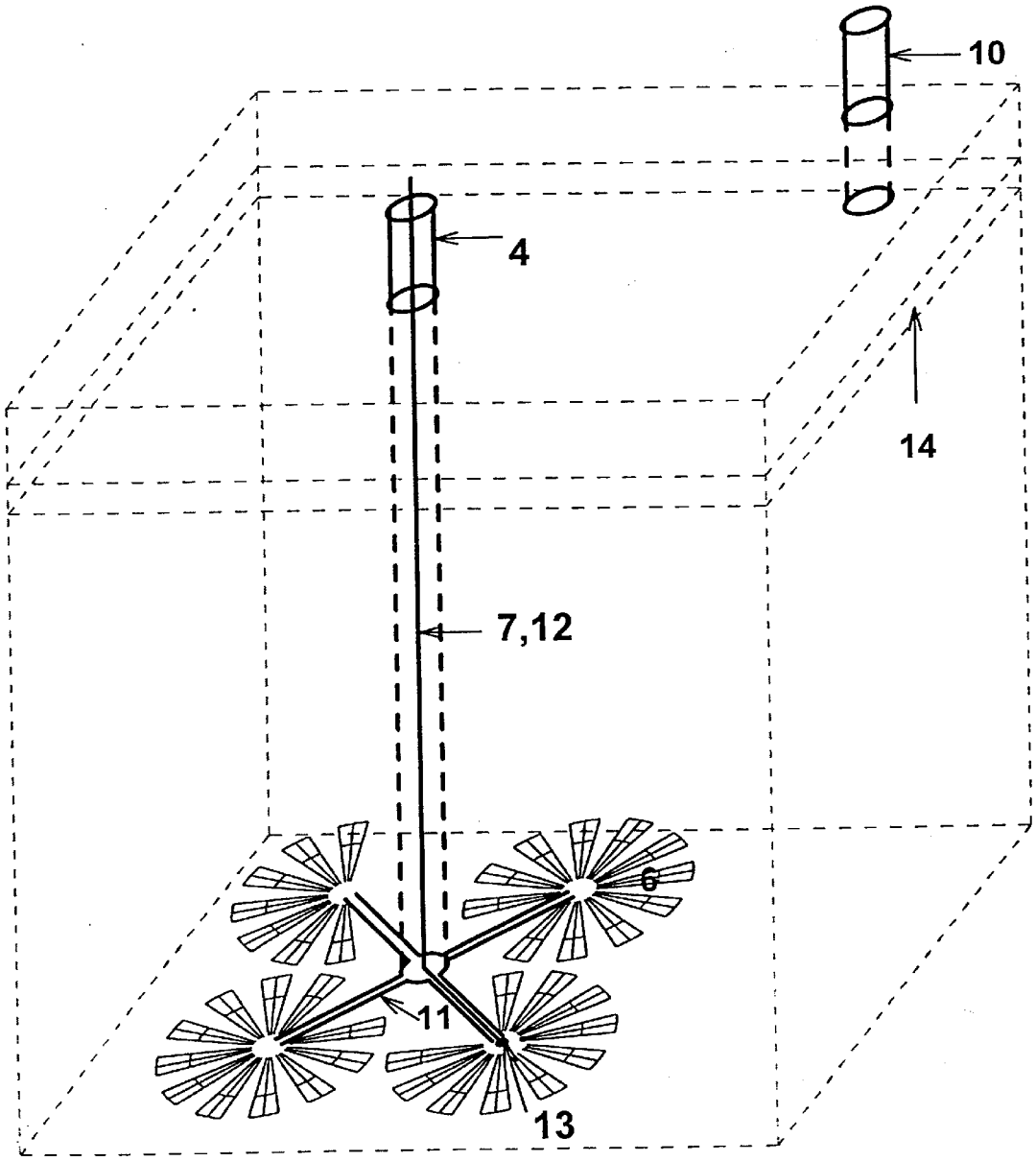
FIG. 3 is a diagrammatic illustration of a hydrocarbon reservoir in a subterranean formation in the process of being modified for enhanced production according to an alternative embodiment of the present invention.
Figure 4:
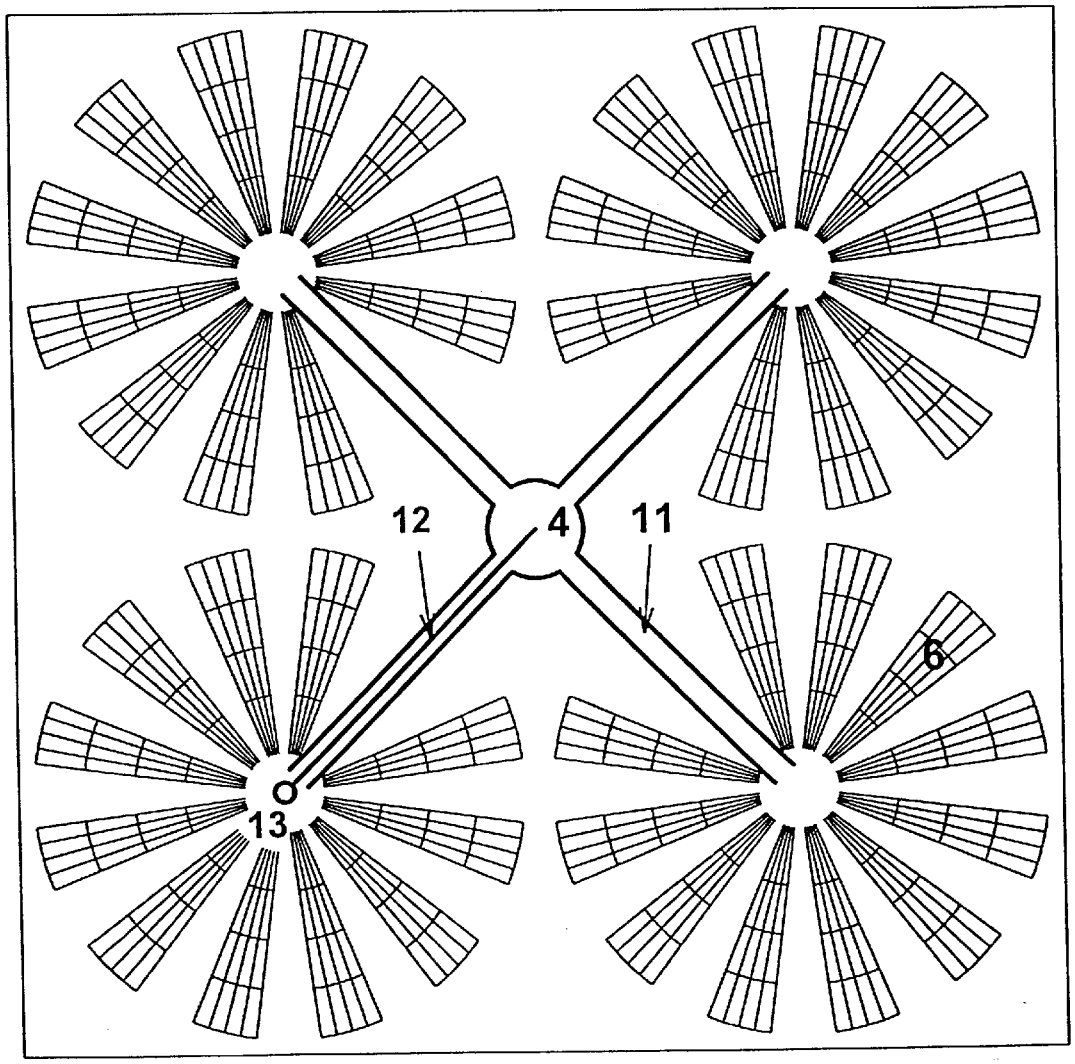
FIG. 4 is a top cross-sectional view of the high-permeability web formed according to the method of FIG. 3.

In an elaborate embodiment, the method of producing oil requires at least one additional injection well 10. The method is depicted in FIG. 3. In this embodiment, a different method of implementing a high-permeability web is illustrated. Four horizontal wells 11, 90 degrees apart, are drilled using conventional or high-pressure water jet drilling technology, as disclosed in U.S. Pat. No. 5,413,184 to Landers or as is known in the art. An antenna 7 or a flexible hose 12 is then inserted into one of these horizontal wells. The antenna generates high-power microwave. The flexible hose generates high-pressure water jet streams. In a preferred embodiment, multiple microwave or water jet beams are radiated from at least one point in a horizontal well, which creates a high-permeability web 6 as shown in FIG. 4. This figure includes the horizontal plane containing the web. The center of the web is the vertical production well 4. The four stems away from the center are the horizontal wells 11. The microwave antenna 7 or the spray head 13 is placed in a position to generate high-permeability webs. Multiple streams of microwave beams or water jets are shot into the formation, creating an array of high-permeability channels. If there is a gas cap or a high-permeability layer 14 at the upper portion of the reservoir, gases can be injected into one of these structures. Otherwise, and if economically warranted, a high-permeability web is created to facilitate injection profile and injection rate. Oil in strata above the layer used for injection is recovered as known in the art as attic oil. In this embodiment, fluids are injected into the upper portion of the reservoir. Injected fluids push oil downward. They are used to enhance volumetric sweep efficiency and improve overall oil recovery. The fluids include, but are not limited to, hydrocarbons, $CO_2$, steam, air, and flue gas. Any enhanced oil recovery method as known in the art is compatible with the high-permeability web. In case a water based agent, such as surfactant and polymer solution, is injected, the injection and production configuration is inverted. Water is injected into the bottom of the reservoir. Oil is produced from the top of the reservoir.

Figure 5:
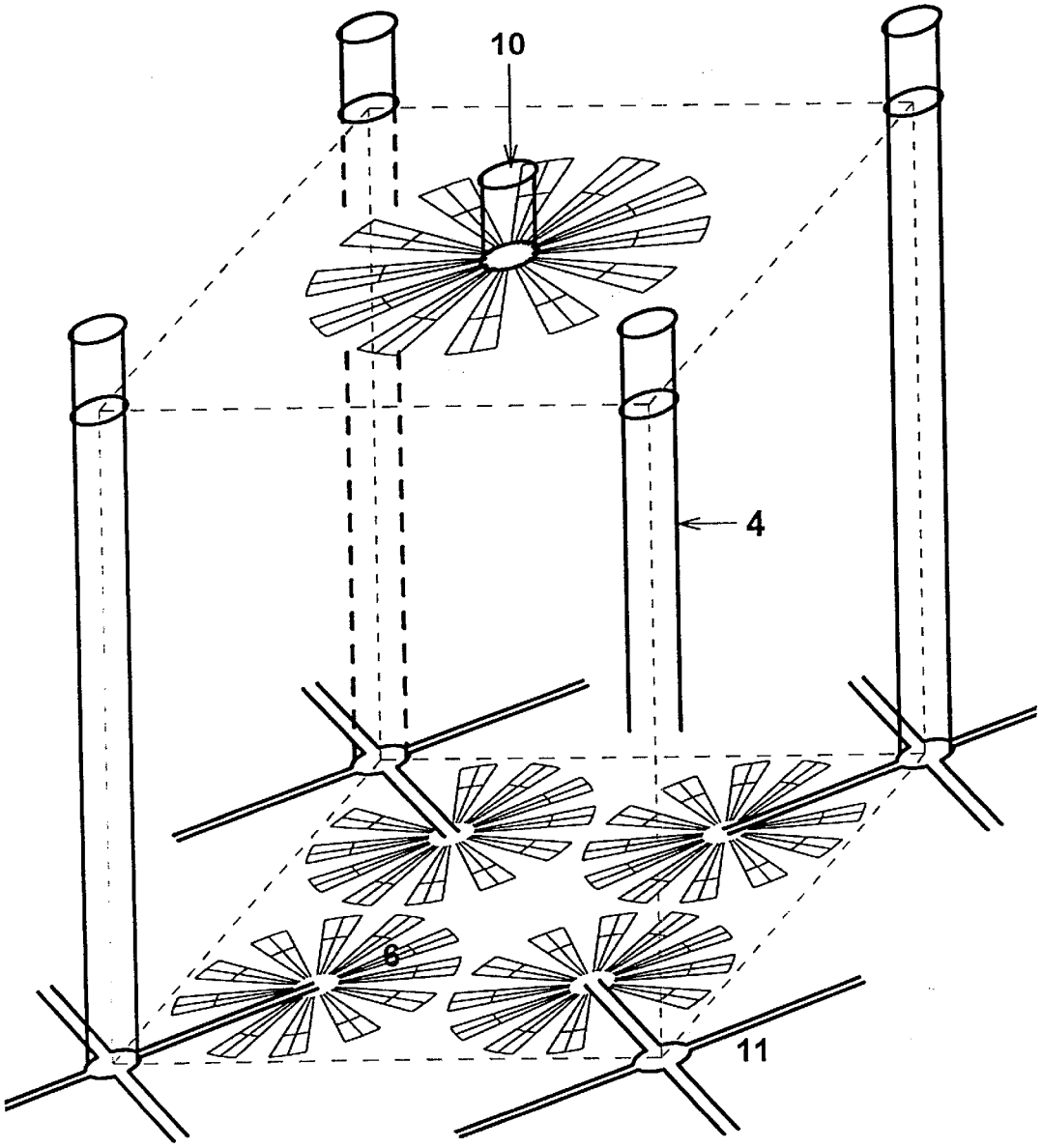
FIG. 5 is a diagrammatic illustration of a hydrocarbon reservoir in a subterranean formation in the process of being modified for enhanced production according to an alternative embodiment of the present invention.

For most of the oil field operations, it is necessary to implement more than one injection well and one production well. The spatial arrangement of wells requires a technical and management decision. High-permeability webs are adapted to a particular well configuration as known in the art. Examples are given to two preferred embodiments. One is an inverted 5-spot pattern to take advantage of existing wells in the field. The other is a laterally and vertically staggered horizontal wells as disclosed in U.S. Pat. No. 5,273,111 to Brannan et. al. An inverted 5-spot pattern has a center injector 10 and four corner producers 4, as shown in FIG. 5. These wells are drilled vertically. A high-permeability web 6 is implemented to each of the producers at the bottom portion of the reservoir. If economically warranted, a high-permeability web is also implemented to the center injector. In this particular embodiment, four horizontal wells 11 are completed. The horizontal wells are connected to the corner producers. Additional high-permeability branches are also created to form a high-permeability web. These branches are connected to the horizontal wells.

Figure 6:
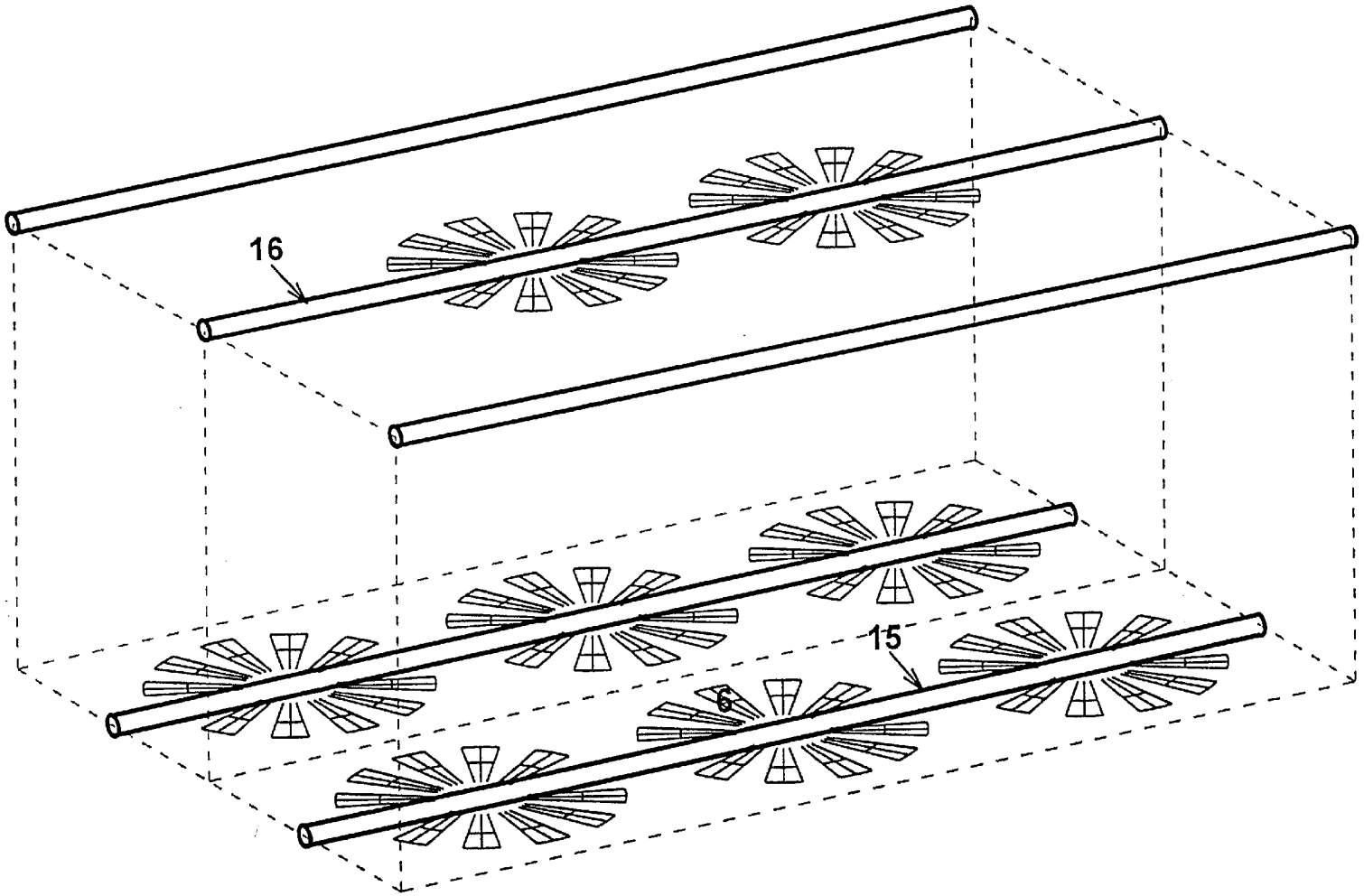
FIG. 6 is a diagrammatic illustration of a hydrocarbon reservoir in a subterranean formation in the process of being modified for enhanced production according to an alternative embodiment of the present invention.

The second preferred embodiment is to apply high-permeability webs to laterally and vertically staggered horizontal wells as shown in FIG. 6. This application is most suitable for newly developed oil fields. The distance between wells depends on the depth of penetration by microwave and/or high-pressure water jet. As a rule of thumb, the further the penetration, the further the distance between adjacent wells. High-permeability webs are created in the plane comprising the bottom horizontal production wells 15. High-permeability webs are also created for the top horizontal injection wells 16. The webs are connected to the horizontal wells. Oil recovery schemes are the same as those described for one injection well and one production well.

The method used for hydrocarbon recovery from subterranean formation also depends on the properties of the formation and the reservoir fluids. Two of the problems affecting a gravity drainage process are low-permeability strata and bottom water coning. A low-permeability layer often acts as the bottleneck for vertical flow. Sometimes, it is more economical to produce from this formation as if there are two separate reservoirs. Sometimes, it is necessary to heat or fracture the low-permeability layer. The methods used for heating and fracturing are disclosed in U.S. Pat. No. 5,449,889 to Samardzija and U.S. Pat. No. 5,299,887 to Ensley. High-power microwave technology is also used for the vitrification of rocks beneath the water-oil contact to mitigate bottom water coning.

The methods disclosed in this invention are also applicable to gas and gas condensate reservoirs and are modified for applications to heavy oil, shale oil and tar sands.

One of the problems at a production well is water conning. To mitigate this problem, microwave technology is used to perform an in-situ vitrification. This can be accomplished by sending a microwave beam at a selected wavelength that will melt the matrix rock below the water-oil contact.

This invention discloses methods of oil recovery based on conformance enhancement, particularly, the generation and use of high-permeability webs. It is contemplated that these methods will improve overall hydrocarbon recovery from subterranean formations and the process economics.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

The present invention, therefore, is well adapted to carry out the objects and attain the ends and advantages mentioned as well as others inherent therein. While presently preferred embodiments of the invention are given for the purpose of disclosure, numerous changes in the details will readily suggest themselves to those skilled in the art and which are encompassed within the spirit of the invention and the scope of the appended claims.

We claim:

1. A method for enhancing recovery of hydrocarbons from a subterranean formation comprising the steps of:

drilling a vertical production well into a hydrocarbon reservoir; and creating a horizontal radial high-permeability web in the subterranean formation proximal to a lower region of the hydrocarbon reservoir adjacent to the vertical production well.

2. The method for enhancing recovery of hydrocarbons according to claim 1, wherein the step of creating a high-permeability web comprises the steps of:

lowering a high-powered microwave antenna into the vertical production well; and generating one or more microwave beams directed outwardly into the surrounding formation from the antenna.

3. The method for enhancing recovery of hydrocarbons according to claim 2, wherein the direction of said one or more microwave beams is substantially horizontal.

4. The method for enhancing recovery of hydrocarbons according to claim 2, wherein said one or more microwave beams are of a high intensity to achieve maximum penetration.

5. The method for enhancing recovery of hydrocarbons according to claim 2, wherein permeability of the formation is increased by an amount greater than one Darcy.

6. The method for enhancing recovery of hydrocarbons according to claim 2, wherein a plurality of microwave beams are simultaneously generated in different directions to form the web comprising a corresponding plurality of high permeability channels.

7. The method for enhancing recovery of hydrocarbons according to claim 1, wherein the step of creating a high-permeability web comprises the steps of:

lowering a flexible hose carrying a spray head on an end thereof into the vertical well; and generating one or more high-pressure water jet streams directed outwardly into the surrounding formation from the spray head.

8. The method for enhancing recovery of hydrocarbons according to claim 7, wherein a plurality of high-pressure waterjet streams are simultaneously generated in different directions to form the web comprising a corresponding plurality of high permeability channels.

9. The method for enhancing recovery of hydrocarbons according to claim 1, further comprising the step of drilling one or more vertical injection wells into an upper region of the hydrocarbon reservoir for injection of a gas into the formation above the hydrocarbons to be recovered.

10. The method for enhancing recovery of hydrocarbons according to claim 9, further comprising the step of creating a high-permeability web in an upper region of the hydrocarbon reservoir proximal to a lower end of the injection well.

11. The method for enhancing recovery of hydrocarbons according to claim 1, further comprising the step of forming one or more horizontal wells extending horizontally outward from a lower region of the vertical production well.

12. The method for enhancing recovery of hydrocarbons according to claim 11, wherein the step of creating a high-permeability web comprises creating a plurality of high-permeability webs extending outwardly from said one or more horizontal wells.

13. The method for enhancing recovery of hydrocarbons according to claim 11, wherein said plurality of horizontal wells comprises four horizontal wells, each one of said four horizontal wells being positioned 90° apart from each adjacent horizontal well.

14. The method for enhancing recovery of hydrocarbons according to claim 13, wherein the step of creating a high-permeability web comprises creating a plurality of high-permeability webs, such that one or more high permeability webs are formed extending outwardly into the subterranean formation from each of the four horizontal wells.

15. The method for enhancing recovery of hydrocarbons according to claim 14, further comprising the step of drilling one or more vertical injection wells into an upper region of the hydrocarbon reservoir for injection of a gas into the formation above the hydrocarbons to be recovered.

16. A method for enhancing recovery of hydrocarbons from a subterranean formation comprising the steps of:

drilling four vertical corner production wells in a square configuration into a hydrocarbon reservoir;

drilling an injection well in the center of the square configuration;

forming one or more horizontal wells extending horizontally outward from a lower region of each one of the four vertical corner production wells; and creating one or more high-permeability webs extending outwardly from each horizontal well.

17. The method for enhancing recovery of hydrocarbons according to claim 16, further comprising the step of creating a high-permeability web in an upper region of the hydrocarbon reservoir proximal to a lower end of the injection well.

18. A method for enhancing recovery of hydrocarbons from a subterranean formation comprising the steps of:

drilling at least two upper horizontal wells into a hydrocarbon reservoir in the formation;

drilling at least one lower horizontal well, each one of said at least one lower horizontal well being spaced laterally and vertically below and between two of said at least two upper horizontal wells, and wherein the upper and lower horizontal wells are substantially parallel; and creating a high-permeability web in the subterranean formation from one or more points along a longitudinal axis of at least one of said upper and lower horizontal wells.

19. The method for enhancing recovery of hydrocarbons according to claim 18, wherein high-permeability webs are created from one or more points along the longitudinal axis of both said two or more upper horizontal wells and said one or more lower horizontal well.

20. The method for enhancing recovery of hydrocarbons according to claim 18, wherein high-permeability webs are created from one or more points along the longitudinal axis of each of said one or more lower horizontal well.

21. The method for enhancing recovery of hydrocarbons according to claim 18, wherein high-permeability webs are created from one or more points along the longitudinal axis of each of said two or more upper horizontal wells.

* * * * *